United States Patent [19]

James

[11] 4,244,126

[45] Jan. 13, 1981

[54] LAMP SHADE REMINDER CLOCK

[76] Inventor: Don S. James, 1020 Bradbourne, Space 77, Duarte, Calif. 91110

[21] Appl. No.: 947,083

[22] Filed: Sep. 29, 1978

[51] Int. Cl.[3] ..... G09F 3/06

[52] U.S. Cl. ..... 40/112; 40/431; 40/502; 40/110; 368/10; 368/39; 368/78; 368/239

[58] Field of Search ..... 40/107, 110, 112, 502, 40/441, 113, 114; 58/4 A

[56] References Cited

U.S. PATENT DOCUMENTS

| | | | |
|---|---|---|---|
| 1,415,686 | 5/1922 | Oppenheim | 40/110 |
| 1,930,048 | 10/1933 | Harding et al. | 40/502 |
| 2,170,408 | 8/1939 | Hillcourt | 40/112 |
| 2,458,092 | 1/1949 | Morris | 40/112 |
| 2,570,803 | 10/1951 | Hausen | 40/502 |

FOREIGN PATENT DOCUMENTS

| | | | |
|---|---|---|---|
| 1078373 | 11/1954 | France | 40/110 |

*Primary Examiner*—Gene Mancene
*Assistant Examiner*—Wenceslao J. Contreras
*Attorney, Agent, or Firm*—Don S. James

[57] ABSTRACT

This invention is a combination of known elements for a new use. This is an adaptation of the old shadow light principle coupled with time to cause three different light apertures to be aligned in a lighted window effect, thereby indicating a previously programmed marking to remind the owner of hourly, daily or weekly radio, television programs, appointments or meetings.

10 Claims, 7 Drawing Figures

LAMP SHADE REMINDER CLOCK

This combination is arranged in the form of the common modern styled cylindrical or conical lamp shade found in most homes and offices. While it is illustrated as an attachment or replacement on an existing common lamp shade fixture with the common standard mounting harp, it could also be built integral with a light source and base and is not meant to limit the invention to a specified form.

Clock control can be of the common geared gradual movement or the step by step escapement advancement periodic impulse method to give alignment from one time period to another.

The outer erasable smooth plastic surface would accommodate the common china marking grease pencil or other temporary marking or erasable material for program marking.

Hourly intervals are hereby illustrated but any more convenient time interval can be built in to the device to accommodate certain processes, programs or functions.

Weekly intervals are hereby illustrated but any more convenient interval can be accommodated, limited only by physical size or fine detail to be shown.

Three lamp shades have been illustrated for a simple lamp shade remainder clock but additional shades may be interspaced for additional programming, color effect, advertising or certain other functions.

Any number of transparencies can be added over the outer lamp shade to indicate special programming, advertising, meetings or re-occurring activities common to a large organization. A series of clips arranged around the outer shade could hold these added transparencies.

Nearly every room in any home and office has a table lamp or floor lamp so the addition of this device is unique and yet decorative and still functional as a clock and a lamp. It is simple and inexpensive to manufacture and simple to operate, requiring no special clips, tools, special tape or replacable paper.

It requires no electrical connection to any other device other than electric power although a manually wound or battery wound spring driven clock movement in connection with any light source is sufficient to operate this invention automatically.

Another innovation requiring a different time interval is suggested where the menstrual cycle would be programmed on the twenty eight day cycle to indicate ovulation time, fertile days, borderline days and infertile days in red, yellow or green color shading as desired, requiring only a glance at the bedroom table lamp to determine the course of action on the part of the owners. Movable shutters on the lamp shade could be relocated if conditions changed appreciably. Many other processes and functions such as in animal husbandry, etc., could be programmed in this manner and in a very unobtrusive yet conspicuous way.

DRAWINGS

Figure 1:
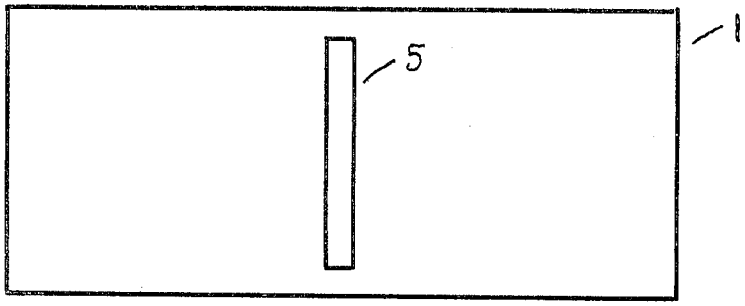

FIG. 1: Illustrates the inner stationary translucent lamp shade 1 on a flat plane with fixed vertical transparent slot 5.

Figure 2:
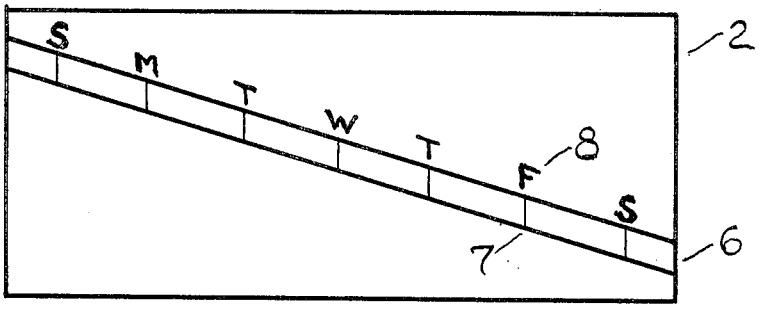

FIG. 2: Illustrates the middle translucent lamp shade 2 on a flat plane with diagonal or inclined slot 6 and permanent markings for days of the week.

Figure 3:
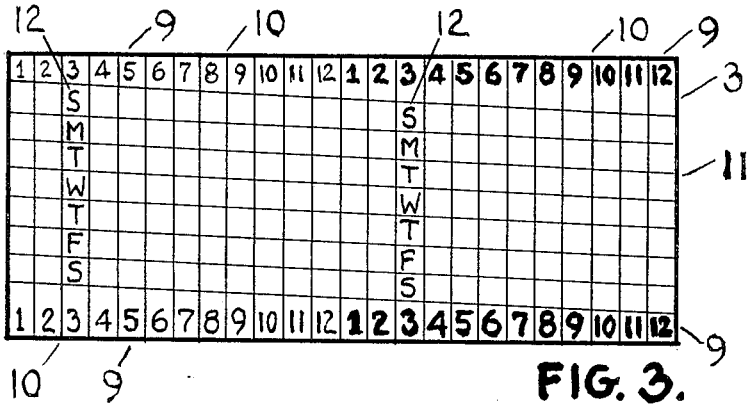

FIG. 3: Illustrates the outer translucent lamp shade 3 on a flat plane with permanent markings for time and day of the week.

Figure 4:
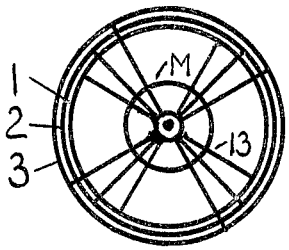

FIG. 4: Illustrates a top view of the three lamp shades assembled on the clock motor.

Figure 5:
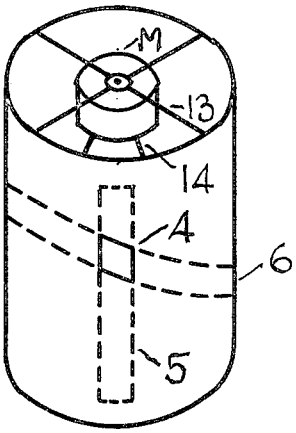

FIG. 5: Perspective view of lamp shade 3 mounted on clock motor and typical lamp harp illustrating lighted window effect due to the intersection of slot 5 on lamp shade 1, slot 6 on lamp shade 2 and markings on shade 3.

Figure 6:
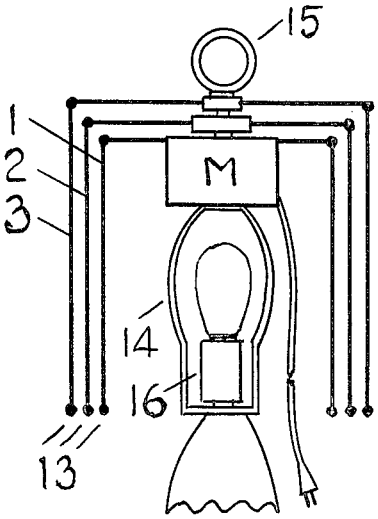

FIG. 6: Section at centerline of clock motor shaft illustrating lamp shades 1, 2 and 3 mounting spiders or frames and elevation of clock motor, typical lamp harp, harp nut, light source, lamp socket and lamp base.

Figure 7:
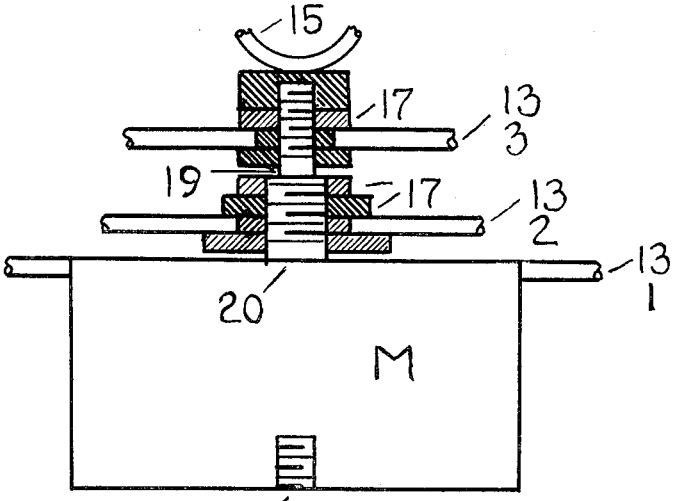

FIG. 7: Enlarged section at centerline of clock motor shaft illustrating method of mounting inner stationary lamp shade and method of driving and adjusting middle lamp shade 2 and outer lamp shade 3.

REFERENCE CHARACTERS

1. Inner stationary translucent lamp shade with fixed vertical transparent slot 5.
2. Middle translucent lamp shade revolving once every seven day week with transparent inclined slot 6 diagonally around the circumference to form a continuous spiral throughout the week as the shade revolves.
3. Outer translucent lamp shade revolving once every twenty four hour day with permanent markings for time of day 9 shown between vertical guide lines 10 and inclined guide lines 11 indicating days of the week.
4. Lighted window on which a mark will indicate whatever item, program or meeting was previously programmed.
5. Vertical slot in shade 1 which remains at the front or viewing area.
6. Diagonal or inclined slot in shade 2 with indicators 7 designating the time of twelve noon on each day of the week 8.
7. Indicators on middle shade 2 on diagonal slot 6 designating the time of twelve noon for time setting purposes.
8. Markings of days of the week on diagonal slot 6 on middle shade 2 for day setting purposes.
9. Permanent markings on outer shade 3 to indicate time of day with light figures designating morning A.M., bold figures designating night or P.M. Twenty four hour clock markings could be shown for continuous or military time.
10. Permanent lines on outer shade 3 dividing time of day.
11. Permanent inclined lines on outer shade 3 arranged in a way that the end of one day aligns with start of the next day to form a continuous spiral throughout the week as the shade revolves from one A.M. Sunday through twelve P.M. Saturday and starting over again with one A.M. Sunday the next week.
12. Permanent markings of the day of the week in light letters or opaque letters on outer shade 3.
13. Typical lamp shade spiders or frames. Standard wire framework as used in the construction of most lamp shades.
14. Typical lamp harp with threaded stud at top used as a standard mounting for most lamp shades.
15. Typical ornamental harp nut used as a standard fastening nut for most lamp shades.
16. Typical light source, socket, lamp base, cord and plug.

17. Nut and locknut. Knurled for finger tightening.
18. Thread to accommodate standard harp stud 14.
19. Inner shaft revolves once every twenty four hours for outer shade 3.
20. Outer shaft revolves once every seven days for middle shade 2.
M. Standard synchronous geared clock motor with cord and plug.

DESCRIPTION

This invention will be described as three common cylindrical lamp shades mounted concentrically upon a clock motor geared driving device altogether mounted upon a lamp harp in the usual fashion common to most homes and offices.

Referring to FIGS. 6 and 7, an assembly consisting of a clock motor M with stationary lamp shade 1 mounted there-on. Said clock motor having two rotating shafts. The outer shaft 20 revolving once every seven days with coupling means 17 to the middle lamp shade 2 and an inner shaft 19 revolving once every twenty four hours with couplings means 17 to the outer lamp shade 3.

Lamp shade 1, FIG. 1, with vertical slot 5 remains stationary, representing the present time which remains at the front or viewing area.

Lamp shade 2, FIG. 2, is the middle shade with a diagonal or inclined slot 6, representing days of the week and therefor revolves once every seven day week producing a spiral of Sunday through Saturday and returning to Sunday at the end of the week as marked as 8.

Lamp shade 3, FIG. 3, is the outer or erasable surface representing the time of the day 9 and therefor revolves once every twenty four hour day on which a message, mark, program or meeting can be inscribed with a suitable erasable china marking grease pencil.

As can be seen in FIG. 4 with the three concentrically mounted lamp shades 1, 2 and 3, the various slots align in the rotating lamp shades in front of the light source 16, FIG. 6, to form a lighted window 4, FIG. 5, where-on the reminder message has been previously inscribed. This lighted window 4, FIG. 5, will sbsequently move on to the next hour or time period throughout the day to the next day throughout the week and repeating the same in the next week for re-occurring programming unless it is erased and a new program or function has been inscribed.

Indicators 7 on the middle lamp shade 2, FIG. 2, in slot 6 designate the time of twelve noon on the seven days of the week 8 for day setting purposes.

Numerical markings 9 on outer lamp shade 3, FIG. 3, indicate time of day within vertical lines 10 and inclined lines 11 to form a lighted square 4, FIG. 5, at a predetermined time. Permanent markings 12, FIG. 3, indicating days of the week are shown in opaque letters to facilitate day and time setting.

FIGS. 4, 5, 6 and 7 illustrate common lamp shade spiders or frames 13, with standard wire framework which are shown attached to common standard lamp harp 14 with harp nut 15 and typical light source 16 with attending lamp base, cord and plug found in any home or office. Knurled nuts and locknuts 17 facilitate adjustment of the lamp shades for proper day of the week and time of the day. Bottom of motor M is threaded 18 to accommodate attachment to said typical standard common lamp harp 14 for convenient and secure mounting as shown in FIG. 7.

With the three lamp shades mounted upon the lamp with the proper register for time of the day and day of the week and the clock motor in operation, then it is a simple matter to consult the daily or weekly radio or television guide for programs desired or the calendar or appointment book for appointments, meetings or functions to be attended during the week and make the proper notations with a simple china marking grease pencil on the smooth erasable surface of the outer lamp shade. The total week of programming is available for visual inspection, additions or changes as the occasion requires, with no effort.

Completely my description I respectfully present my claims

I claim:

1. A constant speed electric motor driven cylindrical or conical translucent lamp shade comprising an erasable surface with permanent markings of the time of the day and day of the week, revolving once every twenty four hour day around a second translucent cylindrical or conical lamp shade with a diagonal or inclined transparent aperture indicating day of the week, revolving once every seven day week around a third stationary cylindrical or conical translucent lamp shade comprising a vertical fixed transparent aperture placed upon a common standard lamp harp and light source thereby emitting a constantly changing lighted window effect on said erasable surface on which notations were previously programmed.

2. A multiple lamp shade reminder clock according to claim 1 wherein said means for driving is an escapement or periodic impulse type electric clock motor.

3. A multiple lamp shade reminder clock according to claim 1 wherein said means for driving is a mechanical spring driven clock motor manually or electrically wound.

4. A multiple lamp shade reminder clock according to claim 1 wherein said means for driving is an escapement of periodic impulse type mechanical spring driven clock motor manually or electrically wound.

5. A constant speed electric motor driven cylindrical or conical translucent lamp shade comprising an erasable surface with permanent markings relating to a certain time period, revolving once every said time period around a second translucent cylindrical or conical lamp shade with a diagonal or inclined transparent aperture indicating multiples of said time period and revolving in multiples of said time period around a third stationary cylindrical or conical translucent lamp shade comprising a vertical fixed transparent aperture placed upon a common standard lamp harp thereby emitting a constantly changing lighted window effect on said erasable surface on which notations were previously programmed.

6. A multiple lamp shade reminder clock according to claim 5 wherein said means for driving is an escapement or periodic implulse type electric clock motor.

7. A multiple lamp shade reminder clock according to claim 5 wherein said means for driving is a mechanical spring driven clock motor manually or electrically wound.

8. A multiple lamp shade reminder clock according to claim 5 wherein said means for driving is an escapement or periodic impulse type mechanical spring driven clock motor manually or electrically wound.

9. An erasable translucent surface arranged in the form of a cylindrical or conical lamp shade permanently marked with vertical lines and numbers indicating the time of the day around the circumference with horizontal inclined lines and lettering arranged in a spiral around said circumference indicating the day of the week and arranged in such a way that the end of one day aligns with the start of the following day allowing the total week to be programmed, said erasable cylindrical or conical lamp shade with suitable hourly markings is made to revolve once every twenty four hours around a second translucent cylindrical or conical lamp shade with a diagonal or inclined transparent aperture and marked for the days of the week, arranged in such a way that it indicates the day of the week in its spiral from the first day to the last day and then returning to the first day revolving once every seven day week around a third stationary cylindrical or conical translucent lamp shade with a vertical fixed transparent aperture all mounted over a light source thereby emitting a constantly changing lighted window effect on said erasable surface on which notations were previously programmed.

10. A program reminder consisting of an erasable translucent lamp shade permanently marked with vertical lines and numbers indicating the time of the day around the circumference with horizontal inclined lines and lettering arranged in a spiral around said circumference indicating the day of the week and arranged in such a way that in one revolution the end of one day aligns with the start of the following day allowing the total week to be programmed, said erasable lamp shade is made to revolve once every twenty four hours around a second translucent lamp shade with a diagonal or inclined transparent aperture and marked for the days of the week arranged in such a way that it indicates the day of the week in its spiral from the first day to the last day and then returning to the first day, revolving once every seven day week around a third stationary translucent lamp shade with a vertical transparent aperture all mounted over a light source thereby emitting a constantly changing lighted window effect on said erasable surface on which notations were previously programmed.

* * * * *